US012564230B2

(12) United States Patent
Rosby, II

(10) Patent No.: US 12,564,230 B2
(45) Date of Patent: Mar. 3, 2026

(54) HEATED GLOVE SYSTEM

(71) Applicant: Gene Rosby, II, Manvel, TX (US)

(72) Inventor: Gene Rosby, II, Manvel, TX (US)

(73) Assignee: Executive & Deliver HTX, LLC, Manvel, TX (US)

( * ) Notice: Subject to any disclaimer, the term of this patent is extended or adjusted under 35 U.S.C. 154(b) by 16 days.

(21) Appl. No.: 18/649,610

(22) Filed: Apr. 29, 2024

(65) Prior Publication Data

US 2025/0228312 A1 Jul. 17, 2025

Related U.S. Application Data

(60) Provisional application No. 63/630,202, filed on Jan. 17, 2024.

(51) Int. Cl.
*A41D 19/015* (2006.01)

(52) U.S. Cl.
CPC .... *A41D 19/01535* (2013.01); *A41D 2400/12* (2013.01)

(58) Field of Classification Search
CPC ..... A41D 19/01535; H05B 2203/036
See application file for complete search history.

(56) References Cited

U.S. PATENT DOCUMENTS 4,950,868 A 8/1990 Moss et al.
5,565,124 A * 10/1996 Balzano ..... H05B 3/34 219/528
6,060,693 A 5/2000 Brown
7,152,248 B2 12/2006 Ziemer
8,008,606 B2 * 8/2011 Kaiserman ..... H05B 3/342 219/548
8,336,119 B2 * 12/2012 Phelps ..... G06F 3/0393 2/160

(Continued)

FOREIGN PATENT DOCUMENTS

CN 103126133 A * 6/2013
CN 220545882 U * 3/2024

(Continued)

OTHER PUBLICATIONS

USPTO, International Search and Written Opinion, PCT/2025025046, Mailed on Jun. 25, 2025.

*Primary Examiner* — F Griffin Hall
(74) *Attorney, Agent, or Firm* — Invention To Patent Services; Alex Hobson

(57) ABSTRACT

A heated glove system incorporates a heated glove with ultrathin resistive heaters that extend on both the backside and palm side of the glove to enable higher tactility and use. A resistive heater may be a thin metal foil that is planar on a substrate material. The resistive heater may extend along a backside portion of the glove and extend up along the finger portions of the backside portion and also along a palm portion and extend up along the finger portion of the palm portion. In this way, a hand is heated on both the backside and palm side substantially over the entire surfaces. The heated glove incorporates a battery, that may be a rechargeable battery and a controller interface having an on/off button and temperature indicator and may include a wireless signal transceiver for relaying information about glove temperatures to a remote electronic device.

17 Claims, 5 Drawing Sheets

(56) References Cited

U.S. PATENT DOCUMENTS

| | | | | |
|---|---|---|---|---|
| 8,664,571 | B2 * | 3/2014 | Macher | A61F 7/007 219/548 |
| 10,257,885 | B2 * | 4/2019 | Chung | A41D 19/01535 |
| 10,285,462 | B2 | 5/2019 | Charles | |
| 11,006,685 | B2 * | 5/2021 | Lamontia | B32B 27/06 |
| 11,606,990 | B2 * | 3/2023 | McIntyre | A41D 1/002 |
| 11,684,099 | B2 | 6/2023 | Shaikh et al. | |
| 12,022,895 | B1 * | 7/2024 | Page | A41D 1/002 |
| 12,274,319 | B2 * | 4/2025 | Jang | A41D 31/06 |
| 2008/0189826 | A1 | 8/2008 | Dilli | |
| 2008/0223844 | A1 * | 9/2008 | Cronn | H05B 3/342 36/2.6 |
| 2009/0032520 | A1 * | 2/2009 | Cronn | H05B 3/565 219/211 |
| 2009/0056107 | A1 * | 3/2009 | Williams | A41B 11/00 29/610.1 |
| 2009/0095735 | A1 * | 4/2009 | Resheff | H05B 3/347 219/545 |
| 2011/0030199 | A1 * | 2/2011 | Rock | H05B 3/342 29/611 |
| 2013/0306614 | A1 * | 11/2013 | Fey, Jr. | A41D 1/00 219/211 |
| 2015/0083705 | A1 * | 3/2015 | Cronn | H05B 3/347 219/549 |
| 2015/0230524 | A1 * | 8/2015 | Stevens | H05B 1/02 219/494 |
| 2016/0095369 | A1 * | 4/2016 | Roberts | A41D 19/01535 2/160 |
| 2019/0142086 | A1 * | 5/2019 | Dunlop | A43B 3/355 219/211 |
| 2019/0216147 | A1 | 7/2019 | Lamontia et al. | |
| 2019/0297970 | A1 * | 10/2019 | Gramlin | B32B 3/08 |

FOREIGN PATENT DOCUMENTS

| | | | | |
|---|---|---|---|---|
| KR | 20110037407 A * | 4/2011 | | A41D 13/0051 |
| WO | WO-03079727 A2 * | 9/2003 | | H05B 3/342 |
| WO | WO-2008023447 A1 * | 2/2008 | | H05B 3/347 |

* cited by examiner

HEATED GLOVE SYSTEM

CROSS REFERENCE TO RELATED APPLICATIONS

This application claims the benefit of priority to U.S. Provisional patent application No. 63/630,202, filed on Jan. 17, 2024; the entirety of which is hereby incorporated by reference herein.

BACKGROUND OF THE INVENTION

Field of the Invention

The invention relates a heated glove system that incorporates a heated glove having ultrathin resistive heaters that extend on both the backside and palm side of the glove to enable higher tactility and use.

Background

Cold weather gloves incorporate bulky insulation to keep a person's hands warm. This bulky, thick insulation reduces normal hand function and grip. Delicate or fine hand motor activities are very difficult if not impossible when wearing these bulky thick gloves.

In particular, athletes have to endure cold temperatures during outdoor sports as these thick gloves limit their performance and ability to catch and/or throw a ball. Their hands become cold and stiff without gloves and this also compromises their performance.

Also, not everyone is outdoors for fun and recreation. Millions of Americans have to work outdoors in cold temperatures, and perform manual, mechanical duties as part of that work. Unfortunately, the gloves they need to wear to protect their hands and fingers wind up substantially affecting their ability to perform their job.

Without gloves, performance and results are directly limited, of course. Cold temperature "decreases manual performance (of the hands and fingers) and decreases flexibility due to increased viscosity within the joints and soft tissues which interferes with smooth joint movements," according to medical studies, and "decreases contraction velocity and maximal strength." Simply put, low temperature restricts hand and finger motion and the speed of that motion, and also substantially reduces grip strength.

Standard gloves produce the same negative effects, however. Additional studies found "muscle force was lost in the hand-glove interface" and determined "wearing gloves may be another risk factor among those whose jobs require repetitive motions and large exertion forces." Those studies on glove use in occupational environments concluded that these "thick, stiff gloves . . . could be trading one health risk for another." In other words, the warmth provided by those standard gloves is needed for safety reasons but, in addition to negatively affecting work performance, the limitations applied by those same standard gloves create other safety risks. Therefore, this creates a Catch-22 circumstance. You need gloves to protect your hands from the elements, but those same gloves restrict you from doing needed tasks. Take them off, you're at risk. Leave them on, you create other risks due to the limitations imposed by those thick, bulky garments.

SUMMARY OF THE INVENTION

The invention relates a heated glove system that incorporates a heated glove with ultrathin resistive heaters that extend on both the backside and palm side of the glove to enable higher tactility and use. An exemplary resistive heater is ultrathin comprising a thin planar resistive layer that is no more than 3 mm thick and preferably no more than 2 mm or even 1 mm thick. The ultrathin resistive heater may extend along a backside portion of the glove and extend up along the finger portions of the backside portion and also along a palm portion and extend up along the finger portion of the palm portion. In this way, a hand is heated on both the backside and palm side substantially over the entire surfaces. The heated glove incorporates a battery, that may be a rechargeable battery and a controller interface having an on/off button and temperature indicator. A heated glove may also include a wireless signal transceiver for relaying information about glove temperatures to a remote electronic device, such as a mobile phone.

An exemplary heated glove has a resistive heater extending along the backside and also along a palm side of the glove. A resistive heater may be a heater grid of a resistive layer that is configured within both the palm portion and backside portion and may extend along the finger portions along both the palm side and backside. A heater grid may substantially cover the palm side area and backside area of the glove, such as about 50% or more of the area, 70% or more, 80% or more, 90% or more, or even 95% or more. A heater grid may extend over substantially all of the surface area of the heated glove to provide effective and uniform heating of a hand configured therein.

An exemplary heater grid includes a grid pattern of a resistive layer on a substrate material and may be an etched material or vapor deposited material, such as a metal or metal alloy. The resistive layer may be a metal or metal alloy foil. A resistive layer may be very thin, such as 2 mm or less, 1 mm or less, 0.5 mm or less or even 0.25 mm or less. The substrate layer of the resistive layer may be a polymeric material, such as an olefin, or material that has relatively high thermal stability such as a polyimide. Also, a resistive heater may have a cover layer, a material configured over the resistive layer and this may be thermally conductive but non-electrically conductive material. The substrate layer may be configured toward or adjacent the exterior material of the glove and may provide additional thermal insulation for the cold exterior temperatures.

The heated glove may include a cuff portion with a cuff opening into the interior of the glove. The heated glove has a hand portion that extends over the palm of the hand and finger portions extending around each of the fingers, including the thumb. The interior may have a fabric for contact with a person's hand. The heated glove has a backside portion, palm side portion and individual finger enclosures including a thumb enclosure, index finger enclosure, a middle finger enclosure, a ring finger enclosure and a little finger enclosure. The backside of the heated glove may include different materials than the palm side and the palm side may include a high friction material configured to provide better tactile grip on objects, such as tools or sports balls or equipment.

The interior and/or exterior material of the heated glove may be a thin material, such as a woven or non-woven blend of fibers, such as a blend of woven polyester and nylon. A waterproof coating may be applied to the exterior to ensure that the glove remains waterproof and this waterproof coating may comprise polyethylene. The interior material may be a thin, plush, material, such as a woven or non-woven and may include nylon, or other polymeric materials, such as fibers. As describe herein, the palm side may include a high friction material configured to provide better tactile grip on objects, such as tools or sports balls or equipment.

The resistive heater may differ from the backside to the palm side having different grid patterns, different grid widths of the resistive layer and/or different thicknesses. The resistive layer may have a coverage area, such as about 15% or more, about 25% or more, about 35% or more, about 50% or more and any range between and include the coverage areas provided. This coverage area, may vary from the backside to the palm side or from region to region within the glove. The fingers may have a higher coverage are than a hand portion of the heated glove as the fingers have more exposure and are prone to getting cold more quickly than the hand portion.

The hand portion of the heated glove may include different materials or different weight or composition of materials than the finger portions. The finger portions, or the palm side of the finger portions may have a lower weight of fabric, such as about 10% lower or more, about 25% lower, or even 50% lower in weight than a hand portion to enable effective dexterity and hand manipulation of tools, sports equipment, and other objects. The heater grid may have a higher coverage area in the finger portion than the hand portion to accommodate for less insulation on the finger portion.

The heated glove includes a controller interface to control the temperature of the glove and a battery to heat the resistive heater. The controller may include a low, medium, and high temperature setting or may allow specific temperature set points to be input. An on/off button may initiate the heating of the glove and provide a flow of electrical current from the battery to the heater grid. A temperature indicator may indicate a relative temperature set point or temperature of the heated glove, wherein a first color, such as green indicates a low temperature or low temperature set point, a second color such as yellow indicates a medium temperature or medium temperature set point and a third color such as red indicates a high temperature or high temperature set point. The on/off button may be used to cycle through different set points and the temperature indicator may be coupled with the on/off button, wherein pushing the on/off button one-time initiates heating as illuminates a first color light, pushing a second time initiates heating to a medium temperature set point and illuminates the second color and pushing a third time initiates a high temperature set point and illuminates the third color to indicate this high temperature set point.

An exemplary heated glove may include a controller interface including a charging port to charge the battery, an on/off button, a temperature indicator, a controller, and a wireless signal transceiver for sending and/or receiving wireless signals.

An exemplary heated glove system may be configured to communicate with a remote electronic device, such as a mobile phone. Data regarding the temperature of the glove may be transferred from the wireless signal transceiver of the heated glove to the wireless signal transceiver of the remote electronic device. The display screen of the remote electronic device may display functions and data from the heated glove, such as glove temperature, as measured by a temperature sensor. A heated glove may have a plurality of temperature sensors, such as one on a backside and one on a palm side of the glove and may include one or more temperature sensors along one or more of the fingers, such as near the tip or extended end of each of the fingers, including the thumb. Also, the remote electronic device may have an interface, such as a touch screen to produce a temperature input for increasing or decreasing a set glove temperature. The remote electronic device may also display battery level and other data regarding the temperature of the gloves or system parameters, such as time on, dates and times used, and the like. The remote electronic device may have a controller and operate an App for interfacing with the heated glove.

It will be apparent to those skilled in the art that various modifications, combinations, and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
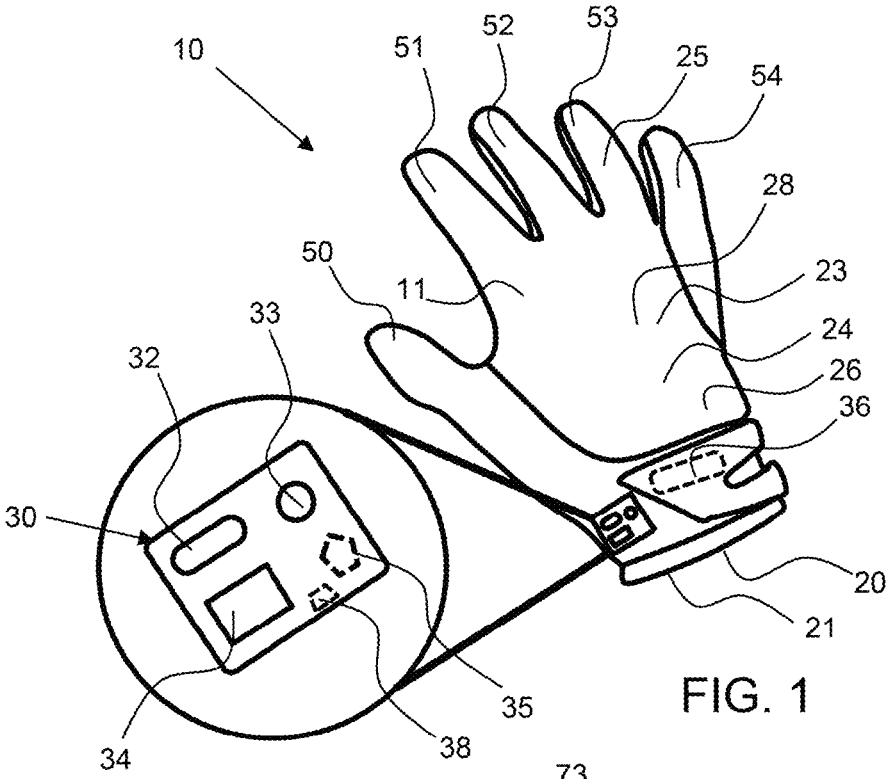
FIG. 1 shows a perspective view of a backside of a heated glove system that includes a glove having a resistive heater powered by a battery and a controller interface to control the temperature of the glove.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be an included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations, and improvements of the described embodiments, will occur to those skilled in the art and all such alternate embodiments, combinations, modifications, improvements are within the scope of the present invention.

Referring now to FIGS. 1 to 5, and exemplary heated glove system 10 comprises a heated glove 11 having a resistive heater 60 extending along the backside and also along a palm side of the glove. A resistive heater may be configured within both the palm portion and backside portion and may extend along the finger portions along the palm side and backside of the finger portions. The heated glove includes a controller interface 30 to control the temperature of the glove and a battery 36 to heat the resistive heater 60. The resistive heater may be a conductive resistor array that is printed of conductive material or etched to produce thin resistive elements.

As shown in FIG. 1, the exemplary heated glove 11 has a controller interface 30 having a charging port 32 to charge the battery 36, an on/off button 33, a temperature indicator 34, a controller 35, and a wireless signal transceiver 38 for sending and/or receiving wireless signals 40. A temperature indicator may be integral with an on/off button wherein the on/off button can be interfaced with by pressing and may have a light that indicates a set temperature. Pressing the on/off button one time may turn the temperature indicator green, for a low temperature set point, pressing the on/off button a second time may change the temperature indicator yellow, to indicate a medium set temperature and pressing the on/off button a third time may change the temperature indicator red to indicate a high or highest set temperature. Pressing the on/off button may index through the set temperatures and then turn the heater off.

The heated glove 11 includes a cuff portion 20 with a cuff opening 21 into the interior 22 of the glove. The heated glove has a hand portion 26 and finger portions 25. The interior may have a fabric for contact with a person's hand. The heated glove 11 has a backside portion 24 including a backside hand portion 28 and finger portion 25 including individual finger enclosures including a thumb enclosure 50, index finger enclosure 51, a middle finger enclosure 52, a ring finger enclosure 53 and a little finger enclosure 54. The backside 23 of the heated glove 11 may include different materials and resistive heaters arrays than a palm side of the heated glove.

Figure 2:
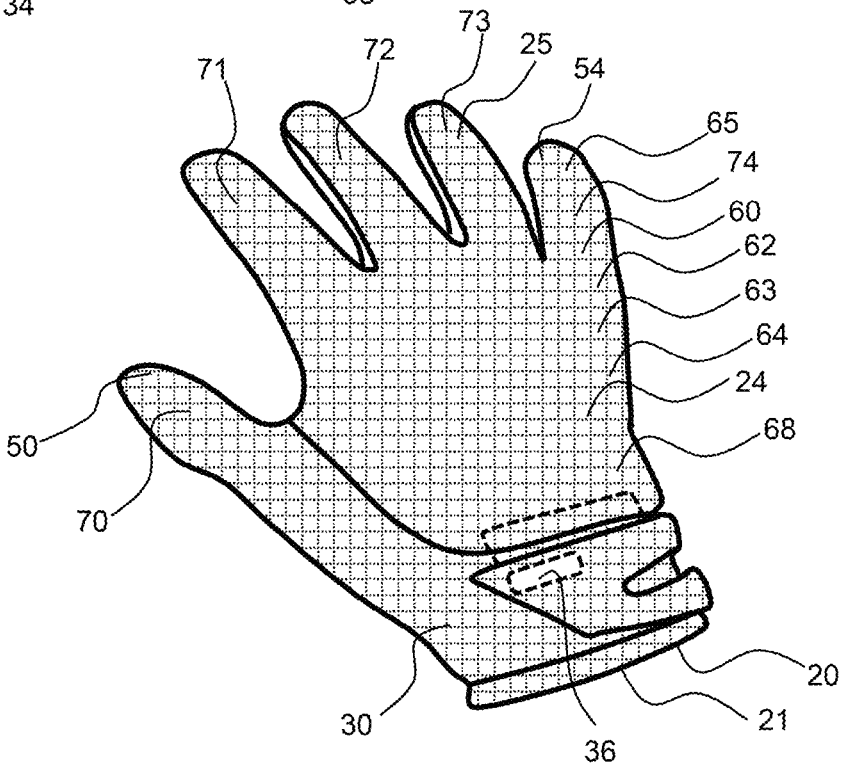
FIG. 2 shows a perspective view of a backside of a heated glove system that includes a heated glove having a heater grid extending from the backside portion of the glove along the backside of the finger portions of the glove.

As shown in FIG. 2, an exemplary heated glove has a resistive heater 60 including a heater grid 62 including a backside heater portion 64 extending from the hand portion 26 along a backside portion 24 of the heated glove. The backside heater portion 64 extends from a backside hand heater portion 68 along the backside of the finger portions 25 and includes a thumb heater 70, an index finger heater 71, a middle finger heater 72, a ring finger heater 73 and a little finger heater 74, wherein each of the backside finger heaters extend within the backside portion 24 of the heated glove up along the individual finger portions 25.

Figure 3:
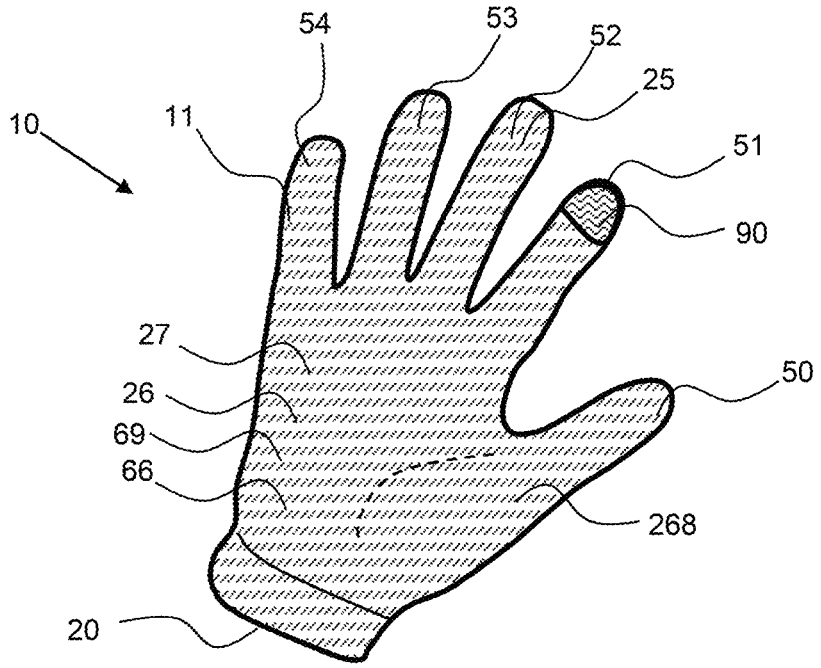
FIG. 3 shows a perspective view of a palm side of a heated glove system that includes a glove having a heater grid powered by a battery and a controller interface to control the temperature of the glove.
Figure 4:
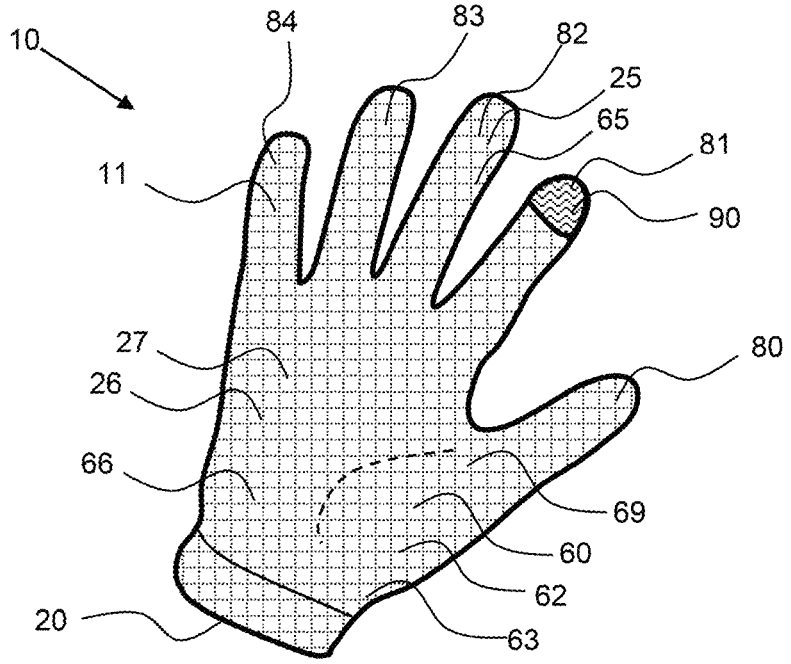
FIG. 4 shows a perspective view of a palm side of a heated glove system that includes a glove having a heater grid including a heater grid extending from the palm portion of the glove along the palm side of the finger portions of the glove.

Referring now to FIGS. 3 and 4, a palm side 27 of a heated glove 11 includes a palm-side hand portion and finger portions 25 and a resistive heater 60 forming a heater grid 62 that includes an array of resistive elements 63. The palm-side heater portion 66 extends from palm-side hand heater portion 69 to palm-side finger heater portions 66 including a thumb heater 80, an index finger heater 81, a middle finger heater 82, a ring finger heater 83 and a little finger heater 84. Also, a conductive material 90, such as a layer or coating is configured over one of the finger portions, such as the index finger enclosure 51 of the heated glove.

Figure 5:
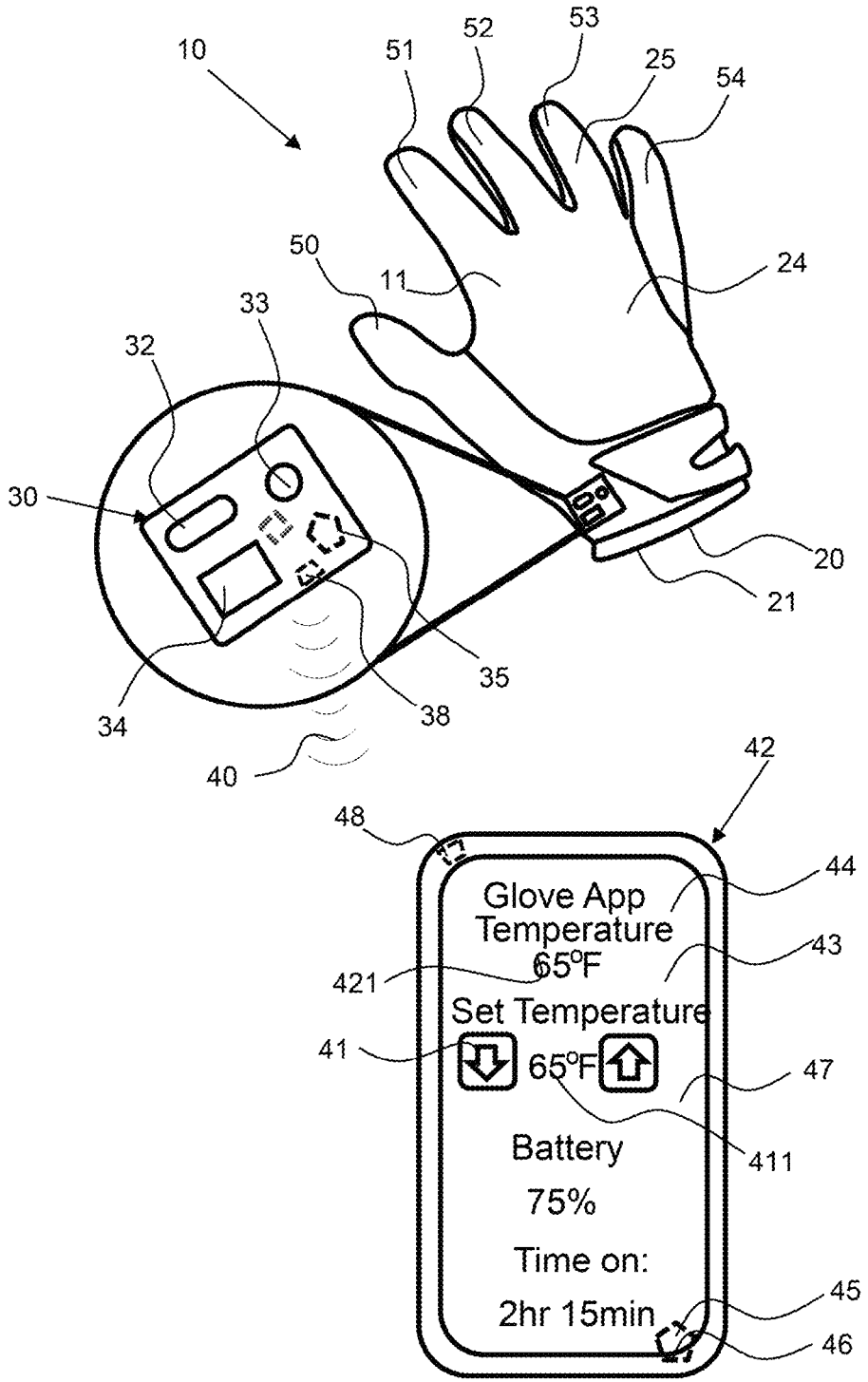
FIG. 5 shows an exemplary heated glove system communicating with a remote electronic device, such as a mobile phone, data regarding the temperature of the glove and wherein the remote electronic device is configured to control the temperature setting of the glove.

As shown in FIG. 5, an exemplary heated glove system 10 is configured to communicate with a remote electronic device 42, such as a mobile phone 44. Data regarding the temperature of the glove may be transferred from the wireless signal transceiver 38 of the heated glove 11 to the wireless signal transceiver 48 of the remote electronic device 42. As shown on the display screen 43, a glove temperature 421 is displayed. Also, the remote electronic device 42 has an interface 47, such as a touch screen to produce a temperature input 41 for increasing or decreasing a set glove temperature 411. The remote electronic device 42 may also display battery level and other data regarding the temperature of the gloves or system parameters, such as time on, dates and times used, and the like. The remote electronic device 42 may have a controller 45 and operate an App 46 for interfacing with the heated glove.

Figure 6:
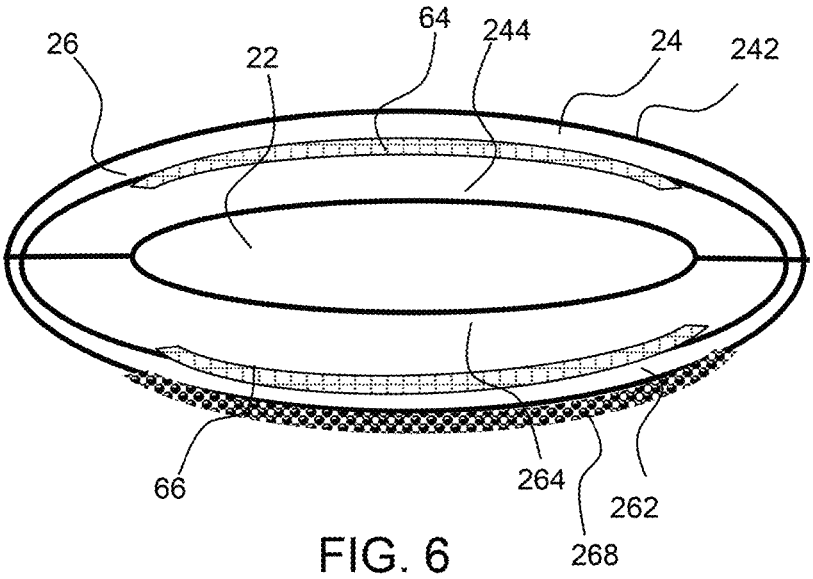
FIG. 6 shows a cross sectional view of the hand portion of the heated glove having a backside portion and palm portion, each with a resistive heater configured between an interior material and exterior material.

FIG. 6 shows a hand portion 26 of a heated glove 11 having an interior 22 of the glove with a backside portion 24 and a palm portion 26 configured around the interior 22. A backside portion has an interior material 244 that contacts the backside of the hand and an exterior material 242. Likewise, the palm portion 26 has an interior material 264 and exterior material 262. The interior materials 244, 264 may be the same material however the exterior materials are preferably different, especially for heated gloves designed for specific activities, such as athletics, wherein a good grip on the palm portion is required. In this case, the exterior material 262 of the palm portion 26 may include a high friction material, 268, as shown. The palm-side heater portion 66 may be configured between the interior material 264 and exterior material 262 of the palm portion 26. Likewise, the backside heater portion 64 may be configured between the interior material 244 and exterior material 242 of the backside portion 24 of the heated glove 11.

Figure 7:
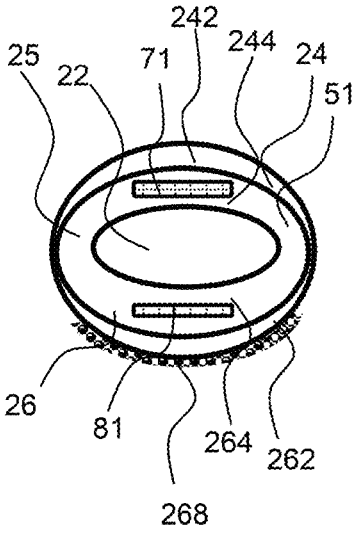
FIG. 7 shows a cross sectional view of finger portion of the heated glove having a backside portion and palm portion, each with a resistive heater configured between an interior material and exterior material.

FIG. 7 shows a finger portion 25 of a heated glove 11 having an interior 22 of the glove with a backside portion 24 and a palm portion 26 configured around the interior 22. A backside portion has an interior material 244 that contacts the backside of the hand and an exterior material 242. Likewise, the palm portion 26 has an interior material 264 and exterior material 262. The interior materials 244, 264 may be the same material however the exterior materials are preferably different, especially for heated gloves designed for specific activities, such as athletics, wherein a good grip on the palm portion is required. In this case, the exterior material 262 of the palm portion 26 may include a high friction material, 268, as shown. The palm-side index finger heater 81 may be configured between the interior material 264 and exterior material 262 of the palm portion 26. Likewise, the backside index finger heater 71 may be configured between the interior material 244 and exterior material 242 of backside portion 24 of the heated glove 11.

Figure 8:
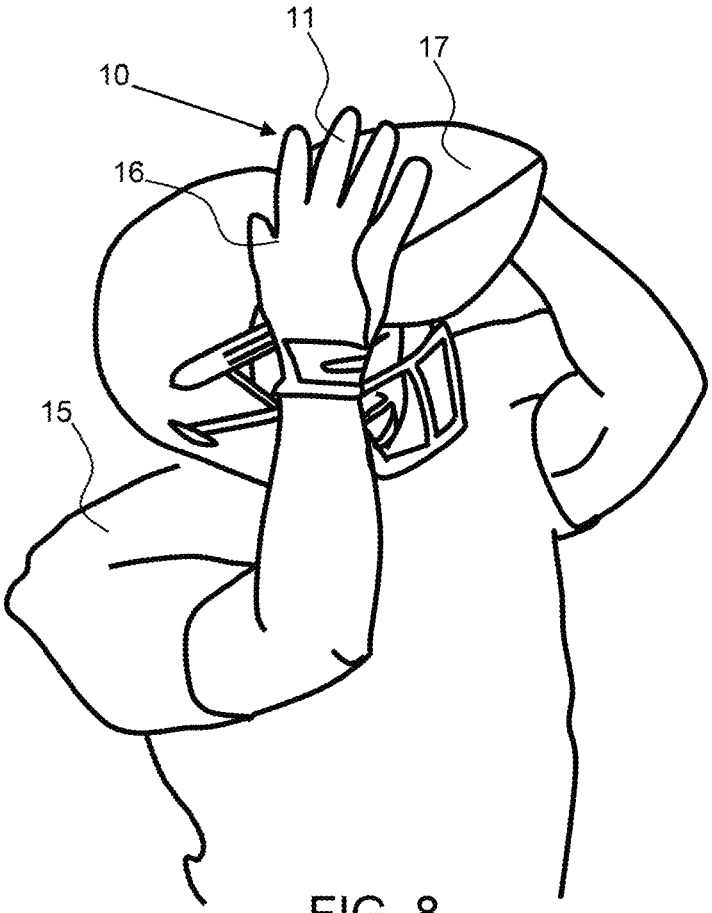
FIG. 8 shows a football player wearing an exemplary heated glove and catching a football.

FIG. 8 shows a person 15, a football player, wearing an exemplary heated glove 11 on their hand 16 and catching a football 17.

Figure 9:
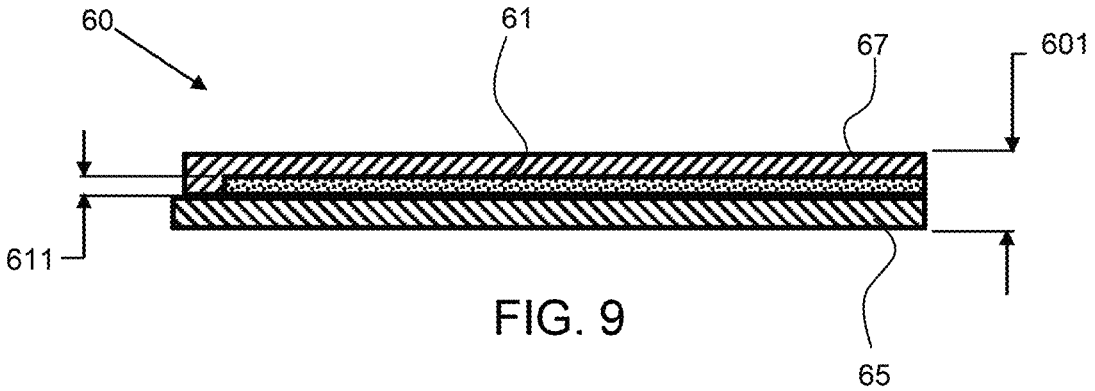
FIG. 9 shows a cross sectional view of an exemplary resistive heater having a resistive layer, such as a metal foil configured on a heater substrate and a heater cover layer.
Figure 10:
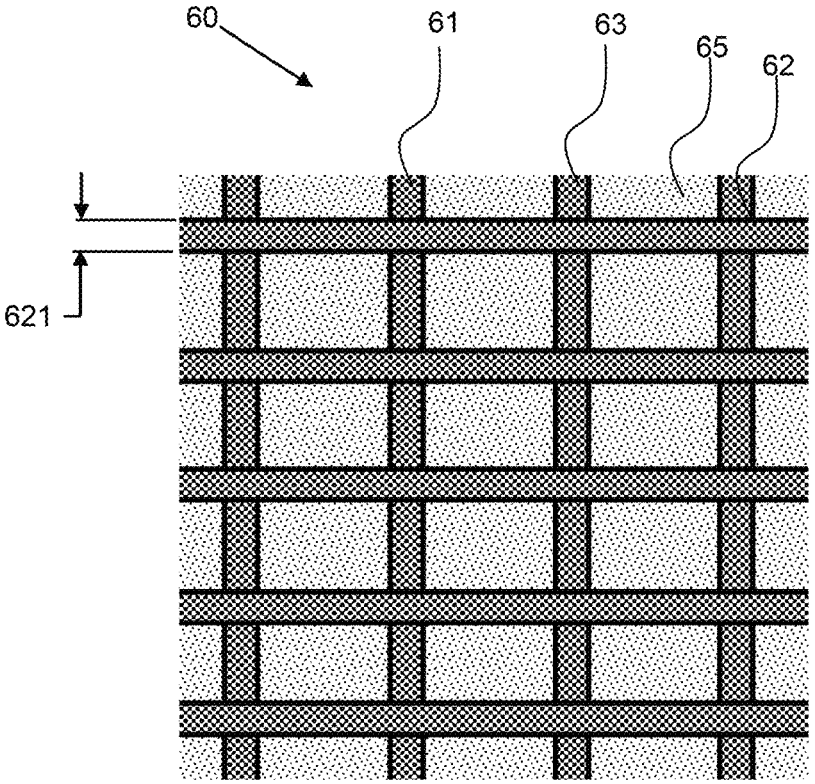
FIG. 10 shows an expanded view of a heater grid having a resistive layer configured in a grid on a substrate and having individual grid elements with a grid width.

Referring now to FIGS. 9 and 10, an exemplary resistive heater 60 has a resistive layer 61, such as a metal foil configured on a heater substrate 65 and a heater cover layer 67. The thickness 601 of the resistive heater may be very thin as described herein, such as about 3 mm or less, about 2 mm or less, or even about 1 mm or less. The thickness 611 of the resistive layer may be ultrathin, such as about 1 mm or less, about 0.5 mm or less, or even 0.25 mm or less. This very or ultrathin resistive heater enables effective heating a person's hand while enabling effective hand use. As shown in FIG. 10, a heater grid 62 has a grid pattern of individual grid elements 622, a resistive element 63 that have a grid width 621 that may be about 1 mm or more, 2 mm or more, 3 mm or more, 4 mm or more and any range between and including the values provided. The percent coverage of the resistive layer as shown is about 20% and as described herein may vary from location to location within the glove.

FIG. 10 shows an expanded view of a heater grid having a resistive layer configured in a grid on a substrate and having individual grid elements with a grid width.

It will be apparent to those skilled in the art that various modifications, combinations, and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A heated glove system comprising a heated glove comprising:
- a) a backside portion comprising:
  - i) a backside hand portion and finger portions;
- b) a palm portion comprising:
  - i) a palm-side hand portion and palm-side finger portions;
  - wherein both the backside portion and the palm portion comprise an exterior material and an interior material;
- c) an interior configured between the backside portion and the palm portion;
- d) a resistive heater comprising a heater grid including a resistive layer configured in a grid that extends from the palm portion to the backside portion and comprising:
  - i) a backside heater portion comprising:
    - a backside hand heater portion; and
    - backside finger heaters;
  - wherein the heater grid of the backside heater portion extends substantially over the backside hand portion extends over 70% or more of an area of the backside hand portion;
  - ii) a palm-side heater portion comprising:
    - a palm-side hand heater portion; and
    - palm-side finger heaters;
  - wherein the heater grid of the palm-side heater portion extends over 70% or more of an area of the palm-side hand portion;
  - wherein the heater grid of the backside heater portion is coupled with the heater grid of the palm-side heater portion;
  - wherein the resistive heater is configured between the exterior material and the interior material of both the backside portion and palm portion; and
  - wherein the resistive layer of the heater grid is a metal foil having a thickness of no more than 3 mm;
- e) a controller interface;
- f) a battery to provide power to the resistive heater; and
- g) a temperature indicator.

2. The heated glove system of claim 1, wherein the metal foil having a thickness of 1 mm or less.

3. The heated glove system of claim 1, wherein the exterior material of the palm portion is different than the exterior material of the backside portion.

4. The heated glove system of claim 3, further comprising a friction material configured on the exterior material of the palm portion.

5. The heated glove system of claim 1, wherein the controller interface further comprises an on/off button.

6. The heated glove system of claim 1, wherein the controller interface further comprises a temperature indicator.

7. The heated glove system of claim 1, wherein the temperature indicator includes a light.

8. The heated glove system of claim 1, wherein the controller interface further comprises a charging port and wherein the battery is a rechargeable battery.

9. The heated glove system of claim 1, further comprising a wireless signal transceiver.

10. The heated glove system of claim 9, further comprising a remote electronic device having a wireless signal transceiver that interfaces with the wireless signal transceiver of the heated glove.

11. The heated glove system of claim 10, wherein the remote electronic device has a temperature display that shows a temperature of the heated glove.

12. The heated glove system of claim 10, wherein the remote electronic device has a temperature input to change a set temperature of the heated glove.

13. The heated glove system of claim 1, further comprising a conductive finger material configured on one of the palm-side finger portions.

14. The heated glove system of claim 1, wherein the conductive finger material is configured on an index finger enclosure.

15. A heated glove system comprising a heated glove comprising:
- a) a backside portion comprising:
  - i) a backside hand portion and backside finger portions;

ii) an exterior material, and
iii) an interior material;

b) a palm portion comprising:
i) a palm-side hand portion and palm-side finger portions;
ii) a conductive finger material configured on an index finger enclosure of said palm-side finger portion;
iii) an exterior material, and
iv) an interior material;

c) an interior configured between the backside portion and the palm portion;

d) a resistive heater comprising a heater grid including a resistive laver configured in a grid that extends from the palm portion to the backside portion and comprising:
i) a backside heater portion comprising:
a backside hand heater portion; and
backside finger heaters;
wherein the backside heater portion is configured between the exterior material and interior material of the backside portion;
ii) a palm-side heater portion comprising:
a palm-side hand heater portion; and
palm-side finger heaters;
wherein the palm-side heater portion is configured between the exterior material and the interior material of the palm portion;
wherein the resistive layer of the heater grid is a metal foil having a thickness of 3 mm or less;

e) a controller interface;

f) a battery to provide power to the heaters;

g) a temperature indicator;

h) a wireless signal transceiver;

i) a remote electronic device having a wireless signal transceiver that interfaces with the wireless signal transceiver of the heated glove;
wherein the remote electronic device has a temperature display that shows a temperature of the heated glove;
wherein the remote electronic device has a temperature input to change a set temperature of the heated glove.

16. The heated glove system of claim 15, wherein the resistive heater comprises a heater grid including a resistive layer configured in a grid and wherein the resistive layer of the heater grid is a metal foil having a thickness of 1 mm or less.

17. The heated glove system of claim 16, wherein the resistive heater has a thickness of no more than 3 mm.

* * * * *